US005512732A

United States Patent [19]

Yagnik et al.

[11] Patent Number: 5,512,732

[45] Date of Patent: Apr. 30, 1996

[54] SWITCH CONTROLLED, ZONE-TYPE HEATING CABLE AND METHOD

[75] Inventors: Chandrakant M. Yagnik, Austin; Blake E. Heimbecker, Schertz, both of Tex.

[73] Assignee: Thermon Manufacturing Company, San Marcos, Tex.

[21] Appl. No.: 1,894

[22] Filed: Jan. 7, 1993

Related U.S. Application Data

[63] Continuation of Ser. No. 586,441, Sep. 20, 1990.

[51] Int. Cl.[6] ..... H05B 3/34; H05B 1/02; H01C 7/02

[52] U.S. Cl. ..... 219/549; 219/504; 219/510; 338/214

[58] Field of Search ..... 219/491, 501, 219/504, 505, 508, 510, 512, 528, 548, 549, 511; 307/117; 338/22 R, 214, 23; 361/161, 165

[56] References Cited

U.S. PATENT DOCUMENTS

| | | | |
|---|---|---|---|
| 2,719,907 | 10/1955 | Combs . | |
| 3,757,086 | 9/1973 | Indoe . | |
| 3,858,144 | 12/1974 | Bedard et al. . | |
| 4,037,083 | 7/1977 | Leavines | 219/552 |
| 4,072,848 | 2/1978 | Johnson et al. . | |
| 4,117,312 | 9/1978 | Johnson et al. | 219/548 |
| 4,250,400 | 2/1981 | Lee | 219/549 |
| 4,320,370 | 3/1982 | Itou et al. . | |
| 4,325,042 | 4/1982 | Endo et al. . | |
| 4,362,917 | 12/1982 | Freedman et al. . | |
| 4,383,231 | 5/1983 | Yamanaka et al. . | |
| 4,389,628 | 6/1983 | Sato et al. . | |
| 4,414,519 | 11/1983 | Anderson, III et al. . | |
| 4,434,411 | 2/1984 | Anderson, III et al. . | |
| 4,454,491 | 6/1984 | Martus . | |
| 4,459,473 | 7/1984 | Kamath . | |
| 4,509,029 | 4/1985 | Bradley . | |
| 4,695,713 | 9/1987 | Krumme . | |
| 4,703,296 | 10/1987 | Katoh . | |
| 4,733,059 | 3/1988 | Goss et al. . | |
| 4,794,229 | 12/1988 | Goss et al. . | |
| 4,922,083 | 5/1990 | Springs et al. . | |

FOREIGN PATENT DOCUMENTS

| | | | |
|---|---|---|---|
| 0212925 | 12/1984 | Japan | 219/490 |

*Primary Examiner*—Teresa J. Walberg
*Assistant Examiner*—Raphael Valencia
*Attorney, Agent, or Firm*—Pravel, Hewitt, Kimball & Krieger

[57] ABSTRACT

A parallel, zone-type heating cable wherein thermally-controlled ferrite reed switches in each zone regulate current flow to heating elements aligned in parallel with each other. Two parallel conductors deliver current to the switches and the heating elements. A dielectric insulation material separates the conductors from each other and the heating elements. The heating cable may further include a component having a particular temperature coefficient of resistance aligned in parallel with the switch to further regulate current flow to a positive but lesser level when the switch is open.

16 Claims, 5 Drawing Sheets

SWITCH CONTROLLED, ZONE-TYPE HEATING CABLE AND METHOD

This is a continuation of co-pending application Ser. No. 586,441 filed on Sep. 20, 1990.

BACKGROUND OF THE INVENTION

1. Field of the Invention

The present invention relates to electrical heating cables that use thermal switches to regulate zone-type heating elements.

2. Description of the Prior Art

Flexible, elongated electrical cables have been used commercially for many years for heating pipes, tanks, valves, vessels and for a variety of other applications. The heating cables maintain the temperature of fluids in pipes or equipment and prevent freezing.

Two significant types of electrical heating cable are currently available. The first is a constant wattage heater of the type depicted in FIG. 1. A constant wattage heater typically comprises two conductors connected to a power supply with a number of resistive elements aligned in parallel with each other and connected to the conductors. Electrical current is supplied to the conductors and passes through the resistive elements to generate heat. Temperature control of a constant wattage heater is generally achieved by means of an external thermostat which delivers or interrupts current to the entire cable based on the temperature of the pipe or the temperature of the cable.

Providing a single external control for the entire cable has significant shortcomings. In many applications, heat requirements may differ significantly for various points on the cable. A constant wattage heater, however, generates heat relatively uniformly along its length in response to a single thermostat control, and has the potential to provide too much heat for certain areas and not enough for others. If the thermostat is not placed in a representative location, the cable may overheat or the fluid may cool below the desired temperature. Further, the high-current controllers used in conjunction with constant wattage heaters may fail in certain high-wattage conditions. Failure of the controller can cause the cable to overheat if failure occurs in the on position, or interrupts heat generation for the entire cable if failure occurs in the off position.

The second major type of heating cable is the self-limiting or self-regulating type, an example of which is shown schematically in FIG. 2. Like a constant wattage cable, a typical self-regulating heating cable comprises a pair of conductors connected to a power supply and has either a number of discrete positive temperature coefficient (PTC) resistive elements connected in parallel with each other, as shown in FIG. 2, or a strip or web of PTC conductive polymer connecting the conductors. Instead of requiring an external thermostat like the constant wattage heaters, the PTC material or elements control the current flow to the resistive heating producing elements.

Self-regulating heating cables using PTC materials produce heat until the cable reaches a temperature limit essentially dictated by the switching temperature of the PTC material. The switching temperature is that temperature at which the resistance of the material rises sharply, often on the order of several orders of magnitude over a relatively short temperature range. The current flowing through the material decreases in response to the increased resistance, limiting the power output and preventing overheating.

As the cable temperature approaches the switching temperature, the resistive element's heat output will begin to diminish. The rate at which the heat output decreases is a characteristic of the PTC material used. For some materials, the heat output changes only gradually, while for others the change is more abrupt. The current will continue to diminish as the temperature rises, but will never completely terminate. A complete disconnection can only be achieved by cutting off the power supply.

PTC material may be used to form the heating element itself. For example, the heating element may comprise a PTC conductive polymer strip connected between the conductors. The heating element can also be a PTC ceramic chip. Alternatively, the PTC material may be connected in series with a heating element having a constant resistance, as shown in FIG. 3. In this case, the PTC material primarily controls the current to the resistor, and only secondarily acts as a heat producing element. In either case, the PTC material has a heat producing aspect which affects its performance. The current flow depends upon the temperature of the PTC material, which is influenced by the heating element's output as well as the temperature of its surroundings.

PTC materials can be subject to hysteresis effects. Some PTC materials behave differently when the cable is heating up than when the cable is cooling down. Consequently, the power on temperature of the cable can significantly differ from the shut off temperature. This disparity is generally undesirable and adds to design and manufacturing difficulties.

SUMMARY OF THE INVENTION

The heating cable of the present invention has a switch to control the current in each heating zone of the cable. In the preferred embodiment, the switch is a thermally operated ferrite reed switch. The switch is connected in series with one or more resistive elements in each heating zone, so that the heating zone delivers full power output when the switch is on and zero power output when the switch is off. The state of the switch depends upon its Curie point, the temperature at which the permeability of the ferrite material changes dramatically. When the switch's temperature is above the Curie point, the switch is off. When the switch cools to below the Curie point, the switch turns on and delivers power to the heating zone. The switching action provides a square wave, in reference to the shape of the curve which results from graphing power output versus temperature for a particular heating zone.

The ferrite reed switch operates magnetically and as a function of temperature, independent of current flow or power output. The switch itself generally produces negligible heat, unless used in a very high current environment, which is not conventional. Consequently, designing a heating cable with a particular switching temperature independent of power output is greatly simplified. The heating cable also includes a number of control points along the length of the cable. As a result, the cable varies the heat generated along its length as required for each particular zone. In addition, the cable uses a number of low current control devices, instead of a single, less reliable high current controller. Further, by reducing the power directed to any single control device, overheating due to an unlikely component failure is virtually eliminated.

The heating cable of the present invention further includes an internal control method that functions independent of the heating element. The heating element may be any heat producing material that can be controlled by the switch. This substantially broadens the range of acceptable heating element materials.

The heating cable design is also significantly less susceptible to the disadvantages arising from hysteresis. A heating cable designed in accordance with the present invention is not controlled by PTC materials. The mechanical switches of the present invention are not subject to hysteresis. Therefore, a heating cable can be easily designed that behaves identically whether the cable is heating up or cooling down.

In an alternate embodiment, a heating element is placed in parallel with the switch so that the power output is switched between two positive levels depending on temperature, not fully on or off. Thus, it reduces switching frequency because the cable does not cool as fast.

BRIEF DESCRIPTION OF THE DRAWINGS

A better understanding of the present invention can be obtained when the following detailed description of the preferred embodiment is considered in conjunction with the following drawings, in which.

DESCRIPTION OF THE PREFERRED EMBODIMENTS

Figure 1:
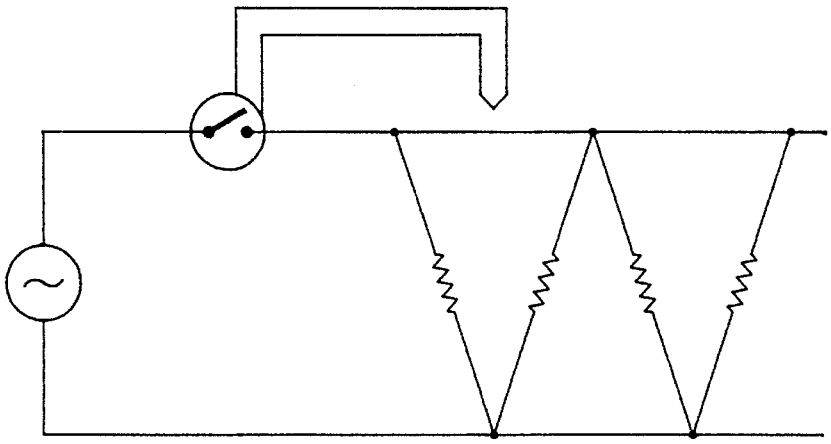
FIG. 1 (PRIOR ART)
FIGS. 1, 2 and 3 are examples of prior art heating cables.
Figure 2:
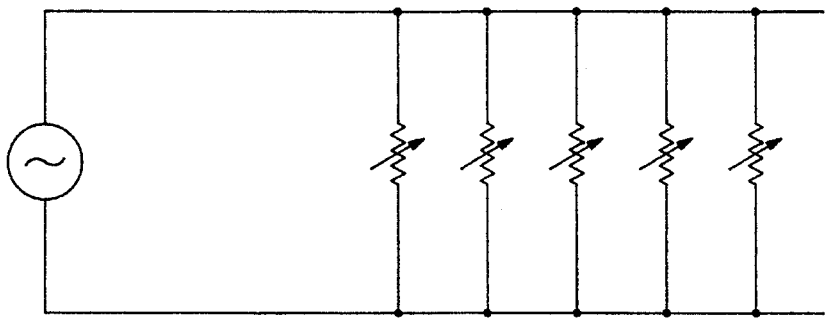
FIG. 2 (PRIOR ART)
Figure 3:
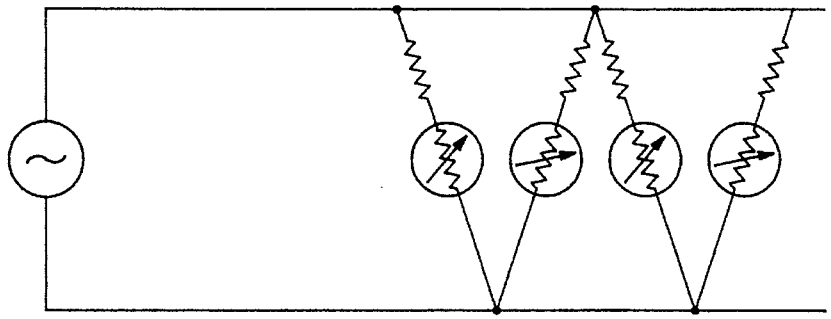
FIG. 3 (PRIOR ART)

Referring to the drawings, the letter C generally designates the heating cable of the present invention, with the numerical suffix indicating the specific embodiment of the cable C.

Figure 4:
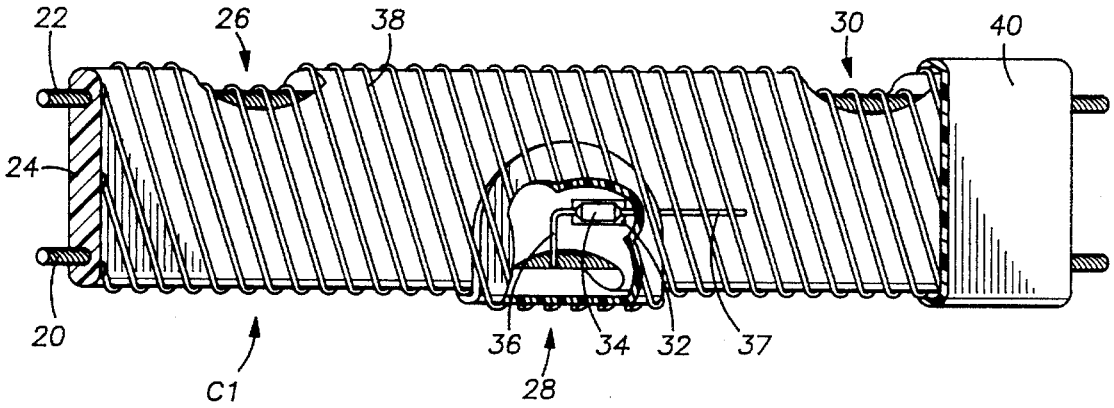
FIG. 4 is a perspective view in partial cross-section of a heating cable including a ferrite switch according to a first embodiment of the present invention.

FIG. 4 illustrates the first preferred embodiment of a heating cable C1 constructed according to the present invention. Two electrical conductors 20 and 22 extend substantially parallel to each other. The electrical conductors are preferably 10 gauge to 20 gauge copper wires, but can be any low resistance electrical conductors. The electrical conductors 20 and 22 are connected in parallel to provide substantially constant voltage along the length of the cable C1.

The conductors 20 and 22 are encapsulated in a dielectric insulation material 24. The insulation material 24 provides electrical insulation for the conductors 20 and 22 and holds them in position. The insulation material 24 may be composed of any flexible dielectric substance as commonly used in heating cables. The insulation material 24 is notched at intervals 26, 28 and 30 along its length so that the conductors 20 and 22 are alternately exposed. A recess 32 is formed in the surface of the insulation material 24 between the conductors 20 and 22.

The heating cable of the present invention has a switch to control the current in each heating zone of the cable. In the preferred embodiments, the switch is a thermally operated reed switch 34, received in the recess 32 in the surface of the insulation material 24. The switch's first lead 36 is connected to the first conductor 20 through the notch 28 exposing the conductor 20. The first lead 36 is connected to the first conductor 20 by any adequate means known to those skilled in the art, such as solder, splices, bands or staples. The second lead 37 of the thermal switch 34 extends over the surface of the insulation material 24. The exposed portions of the conductor 20, the switch lead 36 and portions of the switch lead 37 are covered with insulation tape 65 to protect the conductor 20 or switch lead 36 or 37 from contacting any other conductive elements. A portion of the second lead 37 remains exposed to contact the heating element.

A resistive heating element 38 is helically wound about the insulation material 24. The heating element 38 can be composed of many materials having appropriate resistance. NICHROME is a commonly used resistive material. In a preferred embodiment the NICHROME wire is wound around a stranded fiberglass core, which assembly is then helically wound about the insulation material 24. The heating element could also be a resistive foil such as a copper foil. The resistive material could also be composed of conductive thermoplastic material, such as carbon loaded crystalline thermoplastic polymer. Typically, the conductive compositions of polymer and carbon contain from about 4% to about 30% by weight of electrically conductive carbon black. Ideally, the conductive carbon black is uniformly dispersed throughout the matrix. This material is formed into strands which are helically wrapped. As yet another alternative, the resistive material can be stranded, conductive carbon fibers which are helically wrapped around the insulation material 24.

The heating element 38 contacts the second conductor 22 where the heating element 38 overlaps the notches 26 and 30 exposing the second conductor 22. The heating element 38 contacts the second lead 37 of the switch 34 where it overlaps the second lead 37 on the surface of the insulation material 24. The heating element 38 is connected to the second lead 37 by any adequate means known to those skilled in the art, such as solder, splices bands, staples or a mechanical pressure connection. The switch 34 and the heating element 38 are thus connected in series between the conductors 20 and 22. An overjacket 40 encases the entire assembly to prevent short circuits and for environmental protection.

Figure 5:
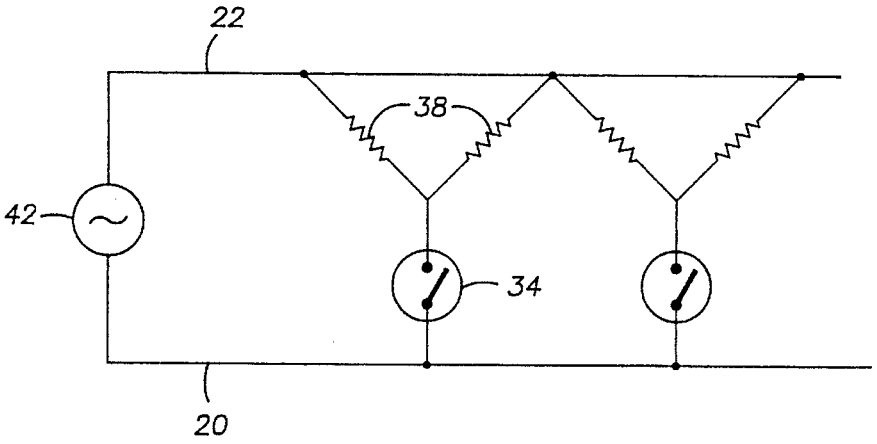
FIG. 5 is an electrical schematic diagram of the heating cable of FIG. 4.
Figure 6A:
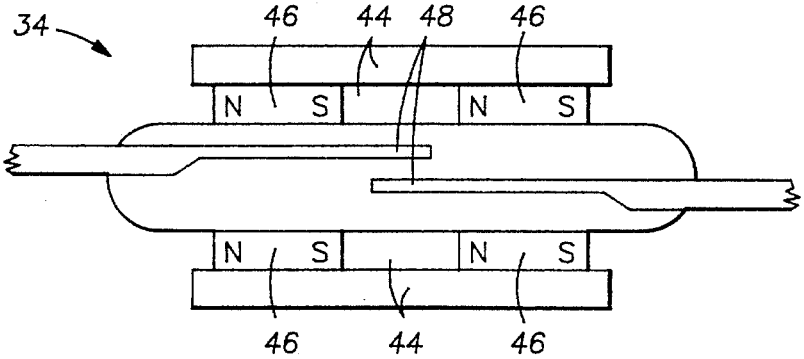
FIGS. 6A, 6B, 6C and 6D are illustrative drawings of ferrite switches according to the prior art.
Figure 6B:
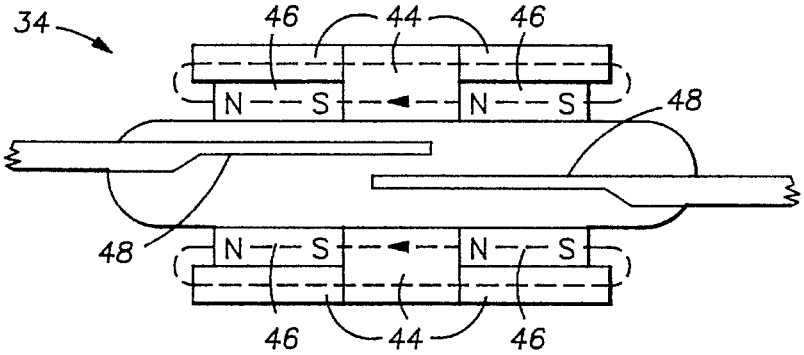
Figure 6C:
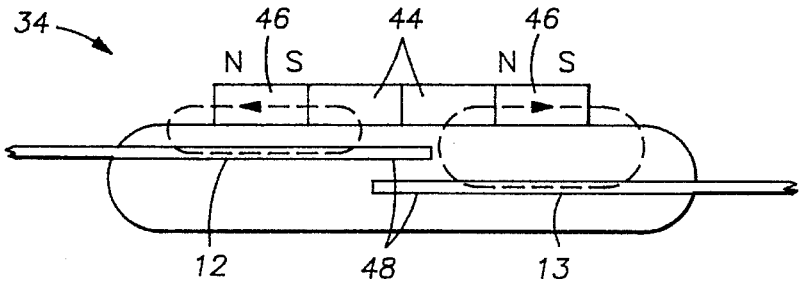
Figure 6D:
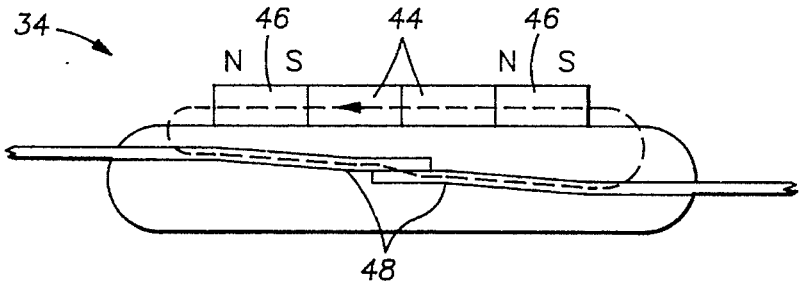

The schematic diagram of FIG. 5 shows the equivalent circuit of the heating cable C1 according to the present invention. The cable C1 is powered by a voltage source 42 connected to the conductors 20 and 22. Current flows through the first conductor 20 to the switch 34. If the switch 34 is on, current flows through the switch 34 to the heating elements 38 and then to the second conductor 22 through a notch 26 or 30. A zone for the cable C1 is thus the distance between the notches 26 and 30, because the heating element 38 between these points is controlled by a single switch 34 and thus is the smallest heating unit in the cable C1. Heat is generated by the current passing through the heating elements 38. When the cable temperature reaches the Curie point or switching point of the switch 34, the switch 34 turns off and interrupts current flow. Thus, the heating zone delivers full power output when the switch is on and zero power output when the switch is off.

The preferred embodiment employs switches that are thermally operated to control current flow to the heating element 38. Thermally operated reed switches which employ ferrite for switching at the Curie point are known in the art, see for example U.S. Pat. Nos. 4,509,029; 4,703,296; and 4,434,411, which are hereby incorporated by reference, and several examples as depicted in FIGS. 6A to 6D. Generally, a ferrite material 44 having a chosen Curie temperature $T_c$ is placed in proximity to one or more permanent magnets 46. The magnets 46 and ferrite material 44 are positioned such that at a temperature below $T_c$, when the ferrite material 44 is in a ferromagnetic state, the magnetic field and lines of flux of the permanent magnets 46 expand to include the ferrite material 44. Above $T_c$ the ferrite's magnetic reluctance is greatly increased and the ferrite material 44 loses its ability to conduct magnetic flux and hence becomes paramagnetic. At this point, the effective magnetic flux shrinks to the size generated by the permanent magnets 46 alone.

The change in size of the magnetic field which occurs at the Curie temperature of the ferrite 44 is thus used to control a switching device, often by opening and closing the contacts of a reed switch 48 located in proximity to the magnets 46 and the ferrite material 44. Below $T_c$ the flux path includes the reed switch 48 which thus closes and forms a current path through the switch 34. Above $T_c$ the flux path does not include the reed switch 48, which thus opens, so that no current path exists through the switch 34. The opening and closing temperatures of the switch 34 are easily selectable by choosing a ferrite material 44 with the desired Curie temperature and by sizing and positioning the various components such as the magnets 46 and the switch conductors 48. Ferrite reed switches are thermally actuated, independent of power output and current flow, and produce negligible heat. Ferrite reed switches can be readily designed to switch at any desired temperature in a range from below about −20° C. to above 130° C., and often to above 500° C. The described switch is only one embodiment of many combinations of magnetic phase changing materials and magnets which may be used to control a switch.

It is also recognized that the present invention is not limited to a single heating element between the switch 34 and the conductor 20. While often a single resistive heat producing element will be utilized, in some embodiments two or more resistive elements of either the same or different designs may be utilized in series with the ferrite switch 34. Such resistors could have a positive temperature coefficient of resistance (PTC), a zero temperature coefficient of resistance (ZTC), or a negative temperature coefficient of resistance (NTC). For example, it is commonly desirable to have a heating cable in which a PTC resistor and a ZTC resistor are aligned in series with each other and the ferrite switch 34 to form a single zone. The resistive element could also be a PTC ceramic chip or a heating element made from a conductive polymer which could have either a positive, negative or zero temperature coefficient of resistance. As is also known to those skilled in the art, the length and resistance of the heat producing element can be chosen to give whatever heat output is desirable for the zone when selected in combination with the power supply voltage.

The self-regulating cable can be made up of as many individual zones of whatever length as is appropriate, but most commonly they will be between several inches to several feet in length. The zones are all connected in parallel to each other between the conductors to form an elongated heating cable of whatever length may be desired. Consequently, each zone generates the heat required for the particular zone which is controlled by a single low current controller.

Three cable samples were prepared according to this first preferred embodiment of cable C1. Ferrite reed switches obtained from Thermo-disk, Inc. of Mansfield, Ohio, models MTS-80B, MTS-90B, and MTS-120B with Curie temperatures of 80° C. (176° F.), 90° C. (194° F.) and 120° C. (248° F.) respectively were used in the three respective samples. Otherwise cable construction was identical for all three samples.

Figure 7:
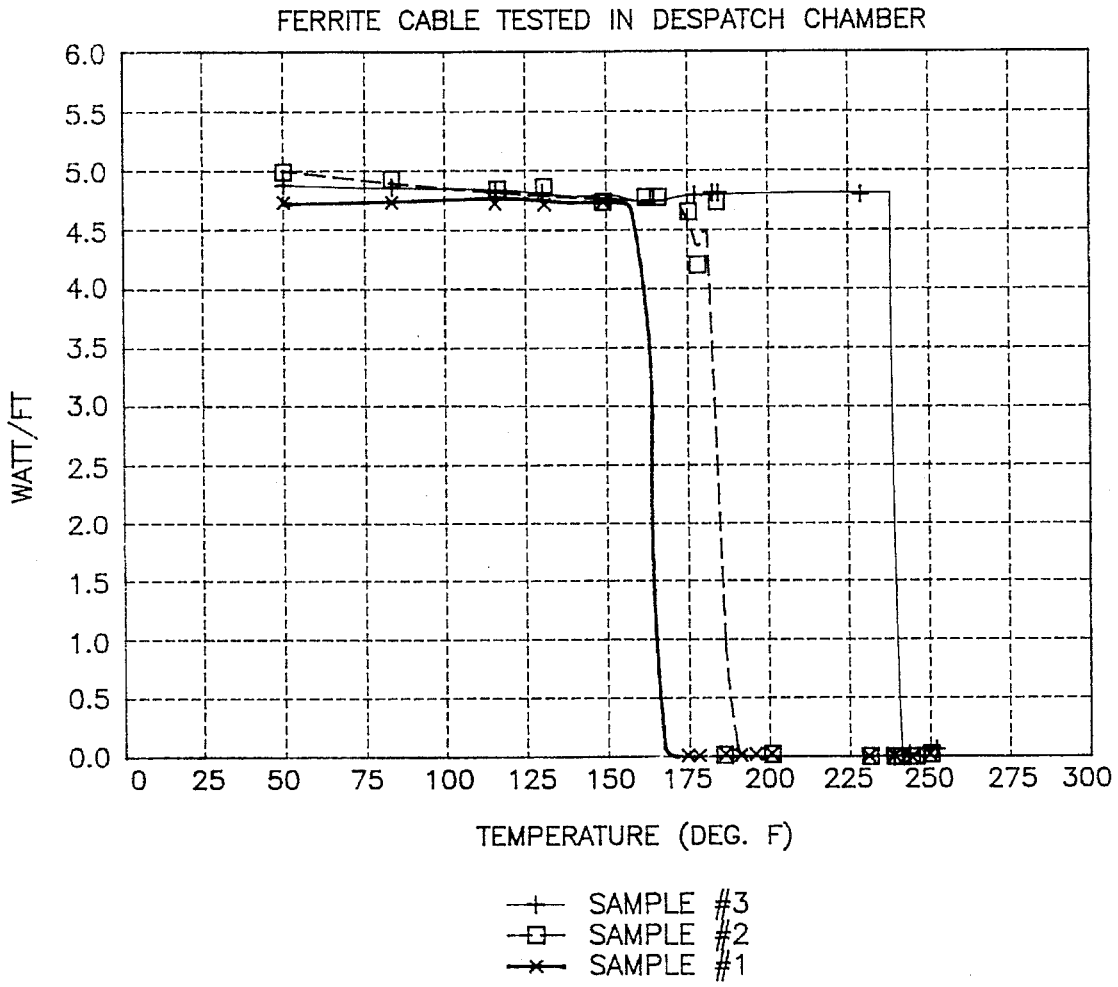
FIG. 7 is a temperature versus power graph for the heating cable of FIG. 4.

The insulation material 24 was a thermoplastic rubber. The ferrite switch lead 36 in contact with the conductor 22 was attached by soldering for good electrical contact. The notches 26, 28 and 30 were 12 inches on center. Electric insulation 65 for the switch leads 36 and 37 and conductor 22 was provided by high temperature TEFLON tape. A 40 gauge nichrome wire having a resistance of approximately 70 ohms/foot was wrapped at a rate of approximately 20 feet per lineal foot of cable to provide approximately 5 watts per foot when used with a 120 VAC power supply. The cable samples were then placed in an environmental chamber. Cable power output was measured and graphed against chamber temperature. The results are shown in FIG. 7. All three cable samples exhibit square wave power curves, referring to the sharp drop in power output at the switching temperature.

A second embodiment of a heating cable of the present invention employs a ferrite switch aligned in parallel with one or more heating elements. The parallel assembly is then connected in series with an additional heating element to form a heating zone.

Figure 8:
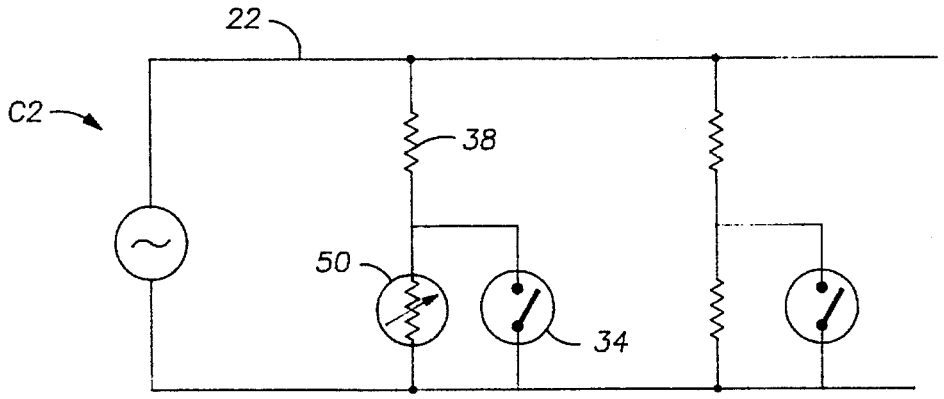
FIG. 8 is an electrical schematic diagram of a heating cable including heating material in parallel with a ferrite switch according to a second embodiment of the present invention.

The cycling time or switching frequency of the ferrite switch 34 can be slowed by connecting a PTC element 50 in parallel with the ferrite switch 34, as shown in FIG. 8. In a cable C2 in which the PTC element 50 has a switching temperature slightly below the Curie temperature of the ferrite switch 34, the result will be a power output which drops appreciably at the opening temperature of the ferrite switch 34. The power output will not, however, drop to zero. The power output is now controlled by the PTC element 50. It is desirable that the PTC element 50 switching temperature be below the ferrite switch 34 switching temperature so that when the ferrite switch 34 opens the PTC element 50 has a relatively high resistance. If the resistance of the PTC element 50 was too low, the cable C2 might continue heating up and cable power output would not be controlled at the ferrite switch 34 switching temperature.

When the above-described cable is installed in circumstances where the lower power output results in an overall cable temperature drop, the normal condition of an installed cable, the cable will function differently from existing cables. In these circumstances when the ferrite switch 34 opens, the cable C2, along with what it is heating, will begin to cool. The cable C2 will still be producing heat, but at a power output such that the overall temperature drops. The temperature is, however, dropping slower than it would were there only the ferrite switch 34 for control because current will still be passing through the PTC element 50 and the primary heating element 38. When the cable temperature falls below the temperature at which the ferrite switch 34 closes, the zone will again produce full power. With full design power being produced, the cable temperature will again climb and the duty cycle begins all over. The net effect of using the PTC element 50 in parallel with the ferrite switch 34 is that the ferrite switch 34 will cycle open and close less frequently than it would otherwise were the switch 34 and the PTC element 50 not disposed in parallel.

The same principle works when the resistive element in parallel with the ferrite switch 34 has a zero temperature coefficient of resistance, such as resistive wire, this example being shown as an alternative in FIG. 8, or a negative temperature coefficient of resistance provided that the resistances are such that the installed cable cools when the switch 34 is open.

Figure 9:
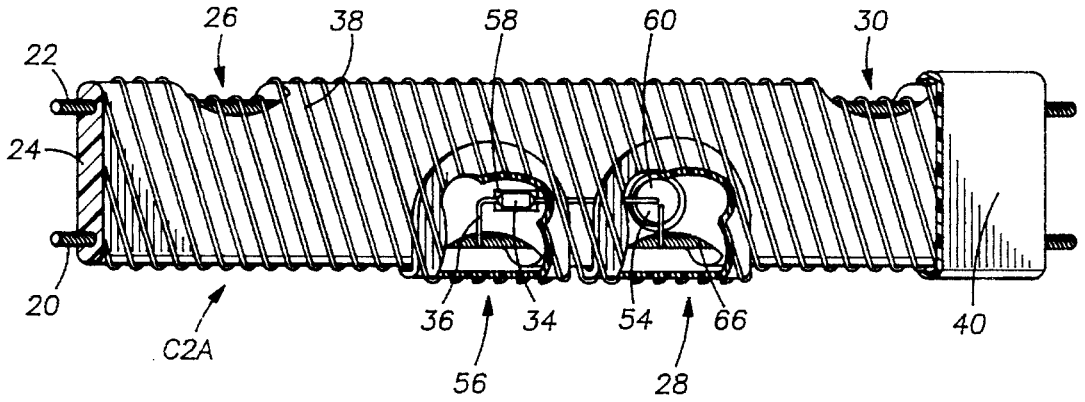
FIG. 9 is a perspective view in partial cross-section of a first alternate construction for the heating cable of FIG. 8.

One preferred embodiment of the cable C2 is a cable C2A as shown in FIG. 9 where a ceramic chip is the PTC element 50. This embodiment utilizes a PTC ceramic chip 54 in parallel with a ferrite reed switch 34. As described in the embodiment of the cable C1, a strip of insulation material 24 is extruded over two conductors 20 and 22. In this embodiment the insulation material 24 is notched at appropriate intervals 26, 28, 30 and 56. Preferably the notches 28 and 56 are located between the notches 26 and 30 and on the alternate conductor. In this case the PTC ceramic chip 54 and the ferrite switch 34 are positioned in recesses 58 and 60 in the insulation material. One lead 36 of the ferrite switch 34 is connected to the first conductor 20, while a second switch lead 37 is connected to one surface of the ceramic chip 54. A third lead 66 is connected from the second side of the ceramic chip 54 to the first conductor 20. All of the exposed wires, including both sides of the ceramic chip 54, are electrically insulated, except that a small section of the lead 37 connecting the switch 34 and the chip 54 is left bare, as are the conductor 22 notched areas 26 and 30.

The cable C2A is then spirally wound with resistive NICHROME wire, for example, with a resistance of 70 ohms/foot at 20.5 feet per one foot zone, a zone here being the distance between the two notches 26 and 30. Again, the entire cable assembly is overjacketed with primary insulation 40. It will be understood that, as with the previous embodiments, it is possible to design a cable with components having any values which may be desired. The example uses one particular set of values for the components in the general cable design for the present embodiment.

The exemplary resistive NICHROME wire has a resistance of 1440 ohms/zone. With a power supply of 120 VAC this will result in a power output of 10 watts per zone when the ferrite switch 34 is in the closed position. In a specific embodiment the cable C2A includes a ferrite switch 34 having a Curie temperature of 165° F. and a PTC ceramic chip 54 having a Curie temperature of 155° F. and a resistance of 500 ohms at 165° F. When the cable temperature reaches 165° F., the ferrite switch 34 opens and in order to complete the circuit of the zone the current passes through the chip 54 giving a total circuit resistance of 1940 ohms. This results in a total power output of 7.4 watts per zone. Again assuming a correctly designed installation, the lower power output will result in a slow lowering of cable temperature so that the ferrite switch 34 will close and power output increases to 10 watts per zone. By including a PTC element 50 in the circuit there is also the assurance that power would gradually begin to fall off even on a less than ideally designed installation. Should the ferrite switch 34 for some reason fail, the zone would regulate to the PTC ceramic chip 54 Curie temperature. Thus, even if the switch 34 fails, some control of the temperature is maintained, though at a slightly lower temperature and not as tightly.

Figure 10:
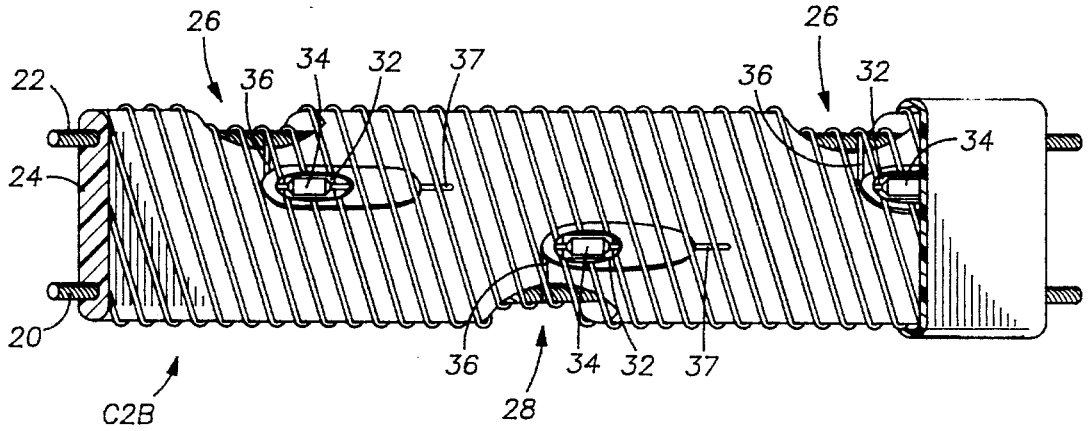
FIG. 10 is a perspective view in partial cross-section of a second alternate construction for the heating cable of FIG. 8.

An embodiment of the invention of a cable C2B using a parallel resistive wire is shown in FIG. 10. As described in the previous embodiment of cable C1, two conductors 20 and 22 are held within a notched insulation material 24, having notches 26, 28 and 30 and the ferrite switches 34 are located in recesses 32 in the center of the insulation material 24. The ferrite switches 34 are arranged with all of their second leads 37 oriented in the same direction along the cable C2B and extending a uniform appropriate distance, such as half the total length of the zone. The zone in this case is the distance between the alternating notches in the cable C2B. The first lead 36 is connected to the conductor 20 or 22. The first lead 36 and an appropriate amount of the second lead 37 are then insulated, such as with high temperature TEFLON tape, except at the notches 26, 28 and 30 so that the conductor 20 or 22 and a portion of the second lead 37 remains exposed. The partially assembled cable C2B is then spirally wrapped with a resistive wire, for example 105 ohms/foot NICHROME wire, so as to make electrical contact with all of the exposed conductors 20 and 22 and second leads 37. The entire cable C2B is then covered with a primary insulation layer 40, for example extruded polyethylene, as is well known to those skilled in the art. In this design, the ferrite switch 34 affectively shorts out or bypasses one-half of the resistive wire between alternating notches 26 and 28 or 28 and 30. When the temperature of the ferrite switch 34 is above its Curie temperature, the current must pass through the entire length of the wire, thus having a reduced power output because of the increased resistance. When the temperature is below the Curie temperature, the ferrite switch 34 is closed and a portion of the resistive wire is bypassed reducing the resistance between the conductors 20 and 22 for that zone, increasing the power supplied. Thus, a minimum amount of power is always being supplied, but greater power is supplied when the zone is below the Curie temperature of the switch 34.

It will be understood by those skilled in the art that one of the advantages of this cable design is that the various components may be selected with whatever values are desirable or appropriate for a specific use. However, for purposes of illustration, cable performance will be described using one assumed set of values for the components as follows. A 120 VAC power source is connected to the conductors 20 and 22. The individual zones, the distance between the notches 26, 28 and 30, are 1 foot long with the exposed or second lead 37 from the ferrite switch 34 extending six inches into the zone. Forty-two gauge, 105 ohms/foot nichrome wire is wound at a rate of 13.7 feet per 6 lineal inches of cable length resulting in a total resistance of approximately 1440 ohms per 6 inches. If the resistance of the ferrite switch 34 in the closed position is assumed to be substantially zero, the total resistance of a zone will be 1440 ohms with the ferrite switch 34 closed, the resistance of the wire from notch 26 to the second lead 37 of the switch 34 connected to the other conductor 22. This results in a power output of approximately 10 watts per zone. When the cable C2B reaches the Curie temperature of the ferrite switch 34, the switch 34 will open and current will flow through the second six inch portion of the NICHROME wire wrapped cable C2B to reach the second conductor 22. Because the resistance of the second six inches, that portion which is in parallel to the ferrite switch 34, is also approximately 1440 ohms, the total resistance of the zone becomes approximately 2880 ohms and power output at 120 volts drops to approximately 5 watts per zone.

Assuming the cable is installed on an appropriately designed and insulated pipe, the cable temperature will slowly fall until the cable temperature reaches the power on or Curie temperature of the ferrite switch 34, in this case 162° F. At this point the ferrite switch 34 closes and cable power again returns to 10 watts per zone. The cable C2B heats the pipe until the temperature of the switch 34 exceeds 162° F. The switch 34 opens, the resistance increases to 2880 ohms and the power drops to 5 watts per zone. The pipe begins cooling and the cycle is repeated. It will be recognized that in this embodiment the cable C2B at full power is effectively producing power only at 6 inch intervals or each foot of length. This is acceptable because the axial conduction of heat along both the substrate being heated and along the cable C2B itself will result in relatively even heating over the cable's length. Of course, this embodiment is not the only possible method of utilizing a ZTC resistor in parallel with a ferrite switch and those skilled in the art will readily recognize other variations.

The foregoing disclosure and description of the invention are illustrative and explanatory, and various changes in the size, shape and materials as well as in the details of the illustrated construction may be made without departing from the spirit of the invention, all such changes being contemplated to fall within the scope of the claims.

We claim:

1. An electrical heating cable having a plurality of heating zones, comprising:

first and second electrical conductor means extending substantially parallel to and spaced from each other along the length of the cable for carrying electrical current;

insulation means encapsulating said electrical conductors for electrically insulating said electrical conductors from each other;

heating means in each zone connected to said first electrical conductor for generating heat when electrical current passes through said first heating means;

a thermally actuated switch in each zone connected to said second electrical conductor and connected to said first heating means, said switch being positively open when the switch temperature is above a given temperature and positively closed when the switch temperature is below said given temperature; and a resistive heating element in each zone connected in parallel with said switch, so that current passes through said resistive element when said switch is open and current is shunted substantially around said resistive heating element through said switch when said switch is closed.

2. The heating cable of claim 1, wherein said insulation means has at least one notch in each zone exposing said second electrical conductor and wherein said switch is connected to said electrical conductor at said notch.

3. The heating cable of claim 2, wherein said insulation means has a notch in each zone exposing said first electrical conductor and wherein said heating means is connected to said first electrical conductor at said notch.

4. The heating cable of claim 3, wherein said insulation means includes a recess in each zone in said portion between said first and second electrical conductors and said switch is partially positioned in said recess.

5. The heating cable of claim 4, wherein said switch includes a body and first and second leads, said first lead being connected to said second electrical conductor and said second lead being connected to said heating means, the heating cable further comprising switch insulation means covering said second conductor notch, said switch body, said first switch lead and a portion of said second switch lead.

6. The heating cable of claim 5 wherein said insulation means includes a notch in each zone associated with said resistive heating element exposing said second electrical conductor, wherein said resistive heating element includes a body and a first lead, said first lead being connected to said second electrical conductor at said associated notch, and wherein said second lead of said switch is connected to said resistive heating element body, and the heating cable further comprising resistive heating element insulation means covering said second conductor resistive heating element associated notch, said resistive heating element body and said resistive heating element first lead.

7. The heating cable of claim 5, wherein said heating means includes resistive material which is helically wound about said insulation means and said resistive material contacts said first electrical conductor at said first conductor notch and contacts said second switch lead.

8. The heating cable of claim 7, wherein said heating means resistive material comprises resistive heating wire.

9. The heating cable of claim 8, wherein said heating wire is composed substantially of NICHROME.

10. The heating cable of claim 8, wherein said switch comprises a portion that changes from a ferromagnetic phase to a paramagnetic phase at said given temperature.

11. The heating cable of claim 10, wherein said magnetically changing portion of said switch is composed substantially of ferrite.

12. The heating cable of claim 11, wherein said switch further comprises a reed switch.

13. The heating cable of claim 12, wherein said resistive heating element is composed of electrically resistive wire.

14. The heating cable of claim 12, wherein said resistive heating element has a positive temperature coefficient of resistance.

15. The heating cable of claim 14, wherein the Curie point of said resistive heating element is lower than the Curie point of said switch.

16. The heating cable of claim 15, wherein said resistive heating element comprises a ceramic chip.

* * * * *